US005089796A

United States Patent [19]

Glennon et al.

[11] Patent Number: 5,089,796

[45] Date of Patent: Feb. 18, 1992

[54] EARTH LEAKAGE TRIP INDICATOR

[75] Inventors: Oliver Glennon; James Shortt, both of Ballinasloe, Ireland

[73] Assignee: Square D Company, Palatine, Ill.

[21] Appl. No.: 584,975

[22] Filed: Sep. 19, 1990

[51] Int. Cl.[5] ..... H01N 75/00

[52] U.S. Cl. ..... 335/172; 335/177

[58] Field of Search ..... 335/6, 18, 19, 20, 21, 335/177-182; 361/42-50

[56] References Cited

U.S. PATENT DOCUMENTS

| | | | |
|---|---|---|---|
| 3,440,579 | 4/1969 | Smith | 335/18 |
| 3,440,580 | 4/1969 | Molenaar | 335/18 |
| 3,470,507 | 9/1969 | Hall et al. . | |
| 4,000,444 | 12/1976 | Douglas et al. | 335/21 |
| 4,858,056 | 8/1989 | Russell | 361/42 |

*Primary Examiner*—Leo P. Picard
*Assistant Examiner*—Lincoln Donovan
*Attorney, Agent, or Firm*—Larry I. Golden; Jose W. Jimenez

[57] ABSTRACT

A residual current circuit breaker 1 has a partition wall 3 which separates an over-current protection device 4 from a residual current detection circuit 5. A plunger rod 24 extends through a bore 23 in the armature 21 of a coil 20 and is moved independently through the coil 20 to trip the breaker if a residual current is detected by the circuit 5. The plunger rod 24 is moved by a drive rod 31, the operation of which is controlled by a permanent magnet which retains the drive rod 31 retracted and an electromagnet which allows the drive rod 31 to drive forwardly under the action of a spring 32 in the event of a residual current being detected. The plunger rod 30 is reset by a reset lever 40 which is moved when an operating handle 18 of the breaker moves from a non-tripped to a tripped position upon tripping of the breaker.

15 Claims, 6 Drawing Sheets

EARTH LEAKAGE TRIP INDICATOR

TECHNICAL FIELD

The invention relates to circuit breakers and in particular to circuit breakers of the type having both over-current and earth leakage protection, commonly referred to as residual current circuit breakers (RCCB's).

PRIOR ART

Over-current protective devices have limitations such as delay in operation in situations where there is a relatively high earth loop impedance. Further, over-current protective devices do not detect earth fault currents below their operating current, which currents in certain circumstances may constitute a fire hazard. Accordingly, there is an increasing demand for protective devices providing both over-current and earth leakage protection.

SUMMARY OF THE INVENTION

It is an object of the invention to provide a residual current circuit breaker which is reliable in operation and relatively simple to manufacture.

According to one aspect, the invention provides a circuit breaker for use in a system having line, neutral and ground leads, comprising:

- a housing;
- a breaker assembly in said housing for making and breaking an electrical connection between a movable contact and a stationary contact;
- an operating handle for the breaker assembly;
- means for sensing over-current and thereby tripping said breaker assembly;
- an additional tripping mechanism for tripping of said breaker assembly; and
- means for indicating when the breaker assembly has been tripped by the additional tripping mechanism.

In a particular preferred embodiment of the invention the operating handle is movable to an additional position other than an off or on position to indicate when the breaker assembly has been tripped by said additional tripping mechanism. In a preferred embodiment the additional position of said handle is intermediate the on and off positions.

Preferably said additional tripping mechanism includes a residual current detection circuit and the additional position of the handle indicates when the breaker assembly has been tripped by a residual current fault.

In one embodiment of the invention said over-current sensing means includes a coil and an armature core in the coil. The armature core has an axial bore extending therethrough; and the additional tripping mechanism comprises:

- plunger means mounted within the axial bore of the armature core;
- an actuating device for controlling the movement of said plunger means from a non-tripping position to a tripping position;
- said plunger means being independently movable through the axial bore in the armature core when moving between the non-tripping and tripping positions; and
- means for re-setting said plunger means to the non-tripping position.

In a particularly preferred aspect the circuit breaker is a residual current circuit breaker and includes a residual current detection circuit for detection of a residual current in the system, and wherein said actuating device comprises a residual current actuating device for controlling the movement of said plunger means between a non-tripping position and a tripping position when a residual current fault is detected by said detection circuit.

In one embodiment of the invention the actuating device comprises a drive rod which is movable upon detection of a residual current fault between a non-tripping position and a tripping position in which the drive rod engages and drives said plunger means into the tripping position; means for biasing or urging the drive rod into a tripping position; and means for retaining the drive rod in a non-tripping position.

Preferably the retaining means comprises a permanent magnet to hold the drive rod in the non-tripping position and an electromagnet to neutralize the effect of the permanent magnet on the drive rod upon detection of a residual current fault.

In one arrangement the biasing means comprise spring means for driving the drive rod into a tripping position engaging a plunger means.

Preferably said reset means comprises a reset lever, interposed between the drive rod and a plunger means and a reset actuator for moving the lever to return the drive rod into the non-tripping position against the action of biasing means. In this preferred arrangement the reset actuator comprises the circuit breaker operating handle which engages the reset lever when the handle is moved from the intermediate position to the off position with the contacts opened. The reset lever is pivotally mounted to the housing intermediate the ends thereof and comprises a first lever arm for engagement by the operating handle and a second lever arm interposed between the drive rod and plunger means. Typically the reset lever is of substantially L shape in plan view. Finally, the plunger means comprises a single plunger rod extending through the bore in the armature core. Preferably the plunger rod is of non-ferrous, preferably plastics material.

In one embodiment of the invention engagement means are provided intermediate the ends of the plunger rod for engagement by the armature core upon occurrence of an over-current fault, said engagement means being provided at substantially the mid point along the longitudinal axis of said plunger rod. In one arrangement said engagement means comprises a radially outwardly extending collar engagable in a complementary shaped recess in the armature core. The plunger rod is slidably mounted in a bushing provided in the coil at the end thereof remote from the armature core.

BRIEF DESCRIPTION OF THE DRAWINGS

The invention will be more clearly understood from the following description of some preferred embodiments thereof given by way of example only with reference to the accompanying drawings in which.

DESCRIPTION OF THE PREFERRED EMBODIMENT

Figure 1:
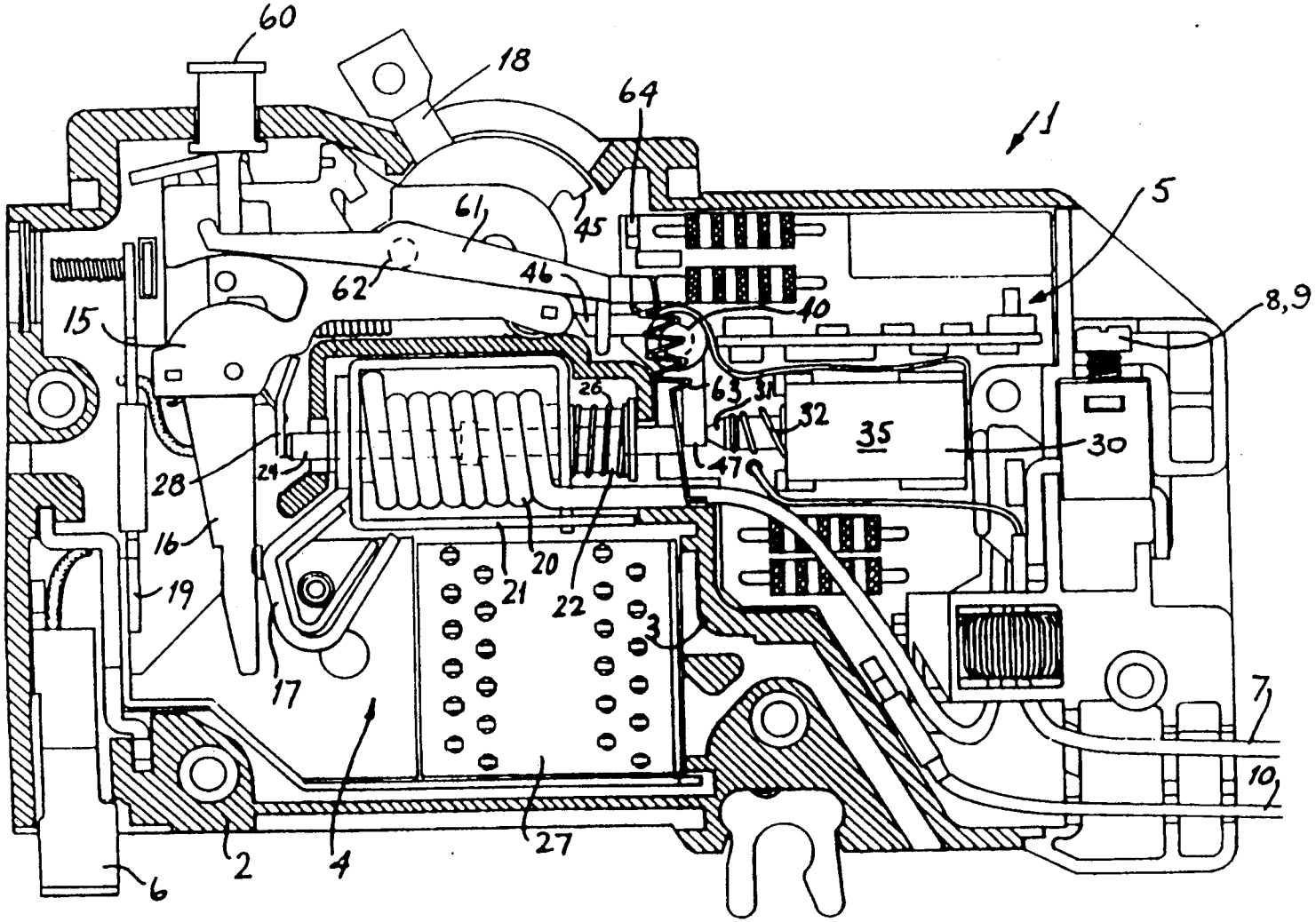
FIG. 1 is a plan view of a circuit breaker according to the invention with the breaker in an on position.
Figure 2:
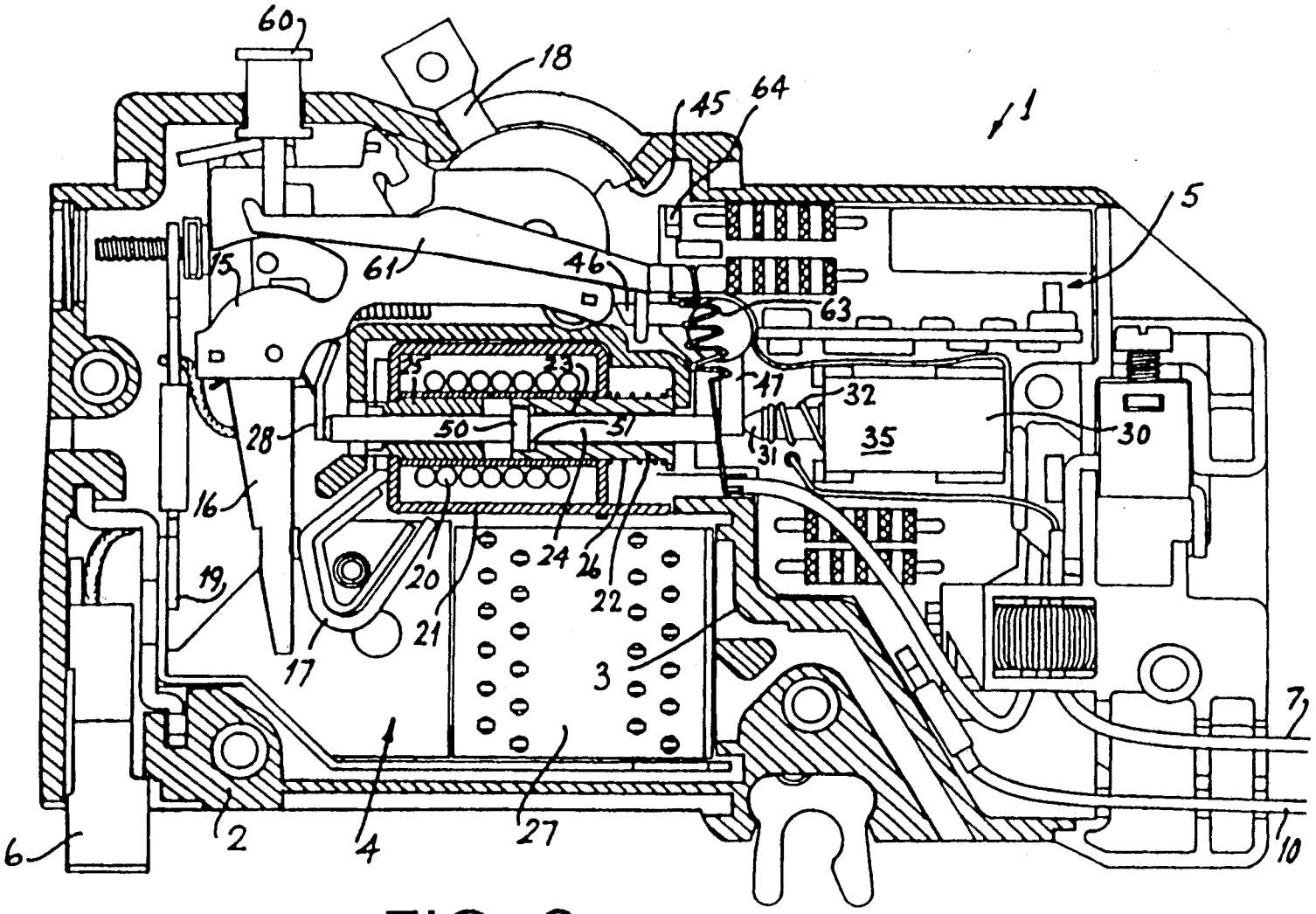
FIG. 2 is a plan, partially cross-sectional view of the circuit breaker of FIG. 1.
Figure 3:
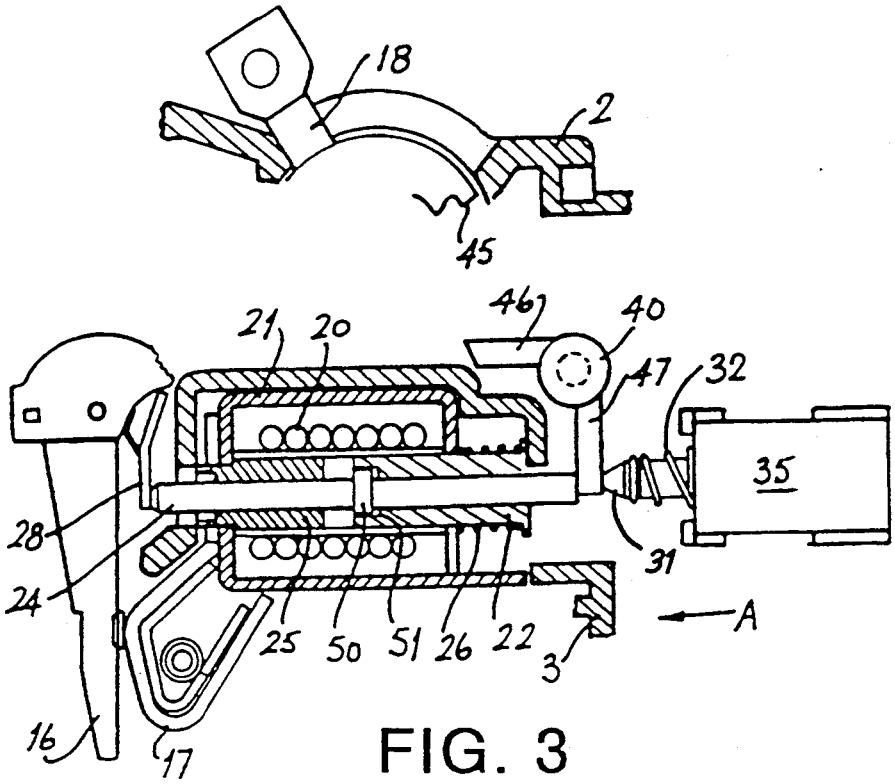
FIG. 3 is a cross-sectional view of a tripping portion of the circuit breaker in an on position.

Referring to the drawings, and initially to FIGS. 1 through 3 there is illustrated a circuit breaker in this case a residual current circuit breaker (RCCB) according to the invention indicated generally by the reference numeral 1. The RCCB 1 comprises a housing 2 having a base and a cover which form a partition wall 3 which separates an over-current protection device 4 from an additional tripping means which in this case includes a residual current detection circuit 5. The RCCB 1 includes line and neutral supply terminals 6 and 7, line and neutral load terminals 8 and 9, and an earth terminal 10. In this case, the line supply terminal 6 is formed by a metal clip for both mechanical and electrical connection with a supply conductor. The line and neutral load terminals 8 and 9 are of the screw-type and are in side-by-side relationship in a side wall of the housing 2. The neutral supply terminal 7 and the earth terminal 10 are of the conventional cable type.

The RCCB 1 includes a breaker assembly 15 which in this case is of the unitary type and includes a movable contact 16 for engagement with a fixed contact 17. The breaker assembly 15 also includes an operating handle 18 of conventional construction. The over-current protecting device 4 comprises a bi-metal element 19 abutting the breaker assembly 15 and an arc stack 27 of conventional construction. The device 4 also comprises a coil 20 having an armature 21 and having an armature core 22 which is biased into a non-tripping position illustrated in FIGS. 1 and 2 by a coil spring 26. An axial bore 23 extends through the core 22.

An additional tripping mechanism which in this case operates in response to a residual current fault occurring, includes a single plunger rod 24 which extends through the partition wall 3, through the bore 23 and through a plunger bushing 25 to impact against a trip lever 28 of the breaker assembly 15 for moving the contact 16 away from the contact 17 to trip the breaker (see FIG. 2). The additional tripping mechanism includes the residual current detection circuit 5 and an actuating device 30 for controlling the movement of the plunger rod 24 between a non-tripping position and a tripping position when a residual current fault is detected by the detection circuit. Actuating device 30 comprises a drive rod 31 which is movable on detection of a residual current fault to engage and drive the plunger rod 24 through the bore 23 to trip the breaker. The drive rod 31 is biased into a forward or tripping position by a coil spring 32 wound around the rod 31. Retaining means for retaining the drive rod 31 in a non-tripping or retracted position comprises a magnetic assembly 35 comprising a permanent magnet to hold the drive rod 31 in a non-tripping position and an electromagnet to neutralize the effect of the permanent magnet on the drive rod 31 upon detection of a residual current fault by the circuit 5.

The plunger rod 24 is in this case made of non-ferrous, preferably plastics material. The rod 24 includes an engagement mechanism in the form of a radially outwardly extending collar 50 which is engagable in a complementary shaped recess in the armature core 22. The collar 50 is provided substantially at the mid-point along the longitudinal axis of the plunger rod 24 so that the rod 24 is substantially symmetrical. Thus, on assembly, the rod 24 may be inserted into the bore 23 in either direction.

A mechanism for re-setting of the plunger rod 24 to a non-tripping position comprises a reset lever 40 interposed between the drive rod 31 and plunger rod 34 and a reset actuator for moving the lever rod 40 to return the drive rod 31 into the non-tripping position against the action of the spring 32. In this case the reset actuator comprises the circuit breaker operating handle 18 which includes an engagement surface 45 which engages against the reset lever 40 as will be described in more detail below.

The reset lever 40 is pivotally mounted to the housing 2 intermediate the ends thereof, is of generally 'L' shape in plan view and comprises a first arm 46 for engagement by the engagement surface 45 of the operating handle 18 and a second arm 47 interposed between the drive rod 31 and plunger rod 24.

A test mechanism for checking the operation of the residual current tripping device comprises a test button 60 engagable against a lever 61 which is pivotally mounted to the housing 2 by a pivot pin 62. A spring 63 biases the lever 61 into the non-test position illustrated in FIGS. 1 and 2. The spring 63 is electrically connected to the coil 20 at one end and the lever 61 is arranged to move the other end of the spring 63 between a non-test position as illustrated in FIGS. 1 and 2 to a test position in contact with a push to test terminal 64.

Figure 4:
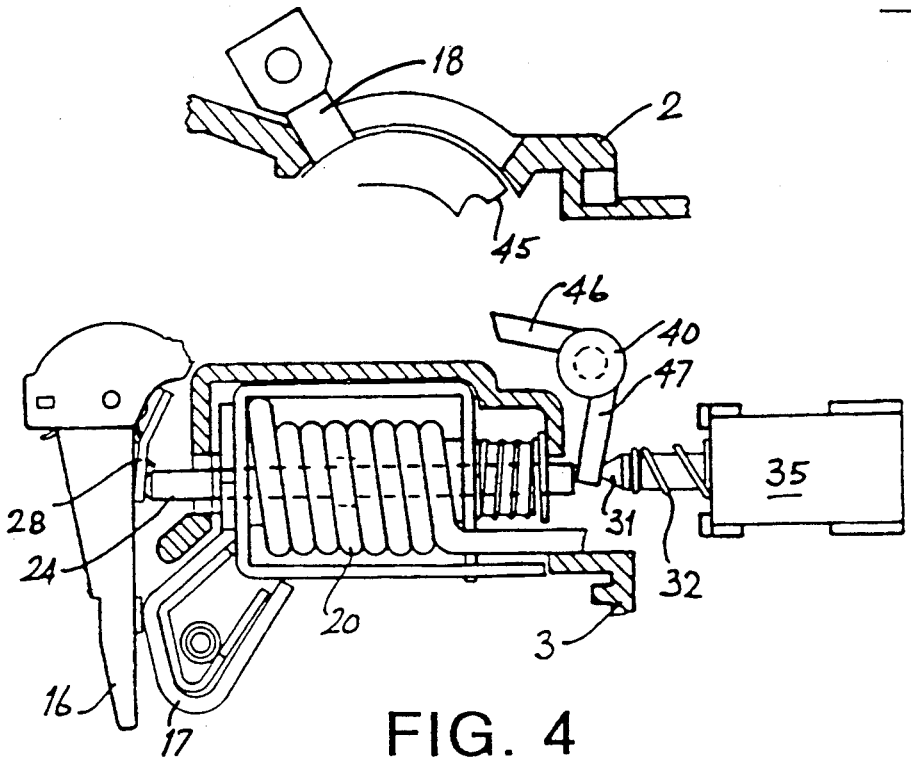
FIG. 4 is a plan view of the tripping portion in a position just after a residual current fault is detected.

In use, and referring particularly to FIGS. 3 through 8 in the normal non-tripped position illustrated in FIGS. 1 and 3 the handle 18 is in an on position fully to the left hand side as viewed in orientation of the drawings, the drive rod 31 is retracted, the reset lever 40 is at right angles to the drive rod 31, the armature core 22 is retracted, the plunger rod 24 is retracted and the contacts 16, 17 are closed. In the event of a residual current fault being detected by the circuit 5 the electromagnet of the magnetic assembly 35 is activated to neutralize the effect of the permanent magnet restraining the drive rod 31, allowing the rod 31 to extend outwardly under the action of the spring 32, striking the lever arm 47 of the reset lever 40 forwardly about its pivot to strike the plunger rod 24 which moves independently through the bore 23 of the armature core 22 to strike the lever 28. This configuration is illustrated in FIG. 4. The striking of the lever 28 releases a spring which moves the contact 16 away from the contact 17 and the handle 18 is thrown into an intermediate position illustrated in FIG. 5 in which the engagement surface 45 engages but does not move the reset lever 40. This intermediate position of the handle 18 indicates that the breaker has tripped due to a residual current fault.

Figure 5:
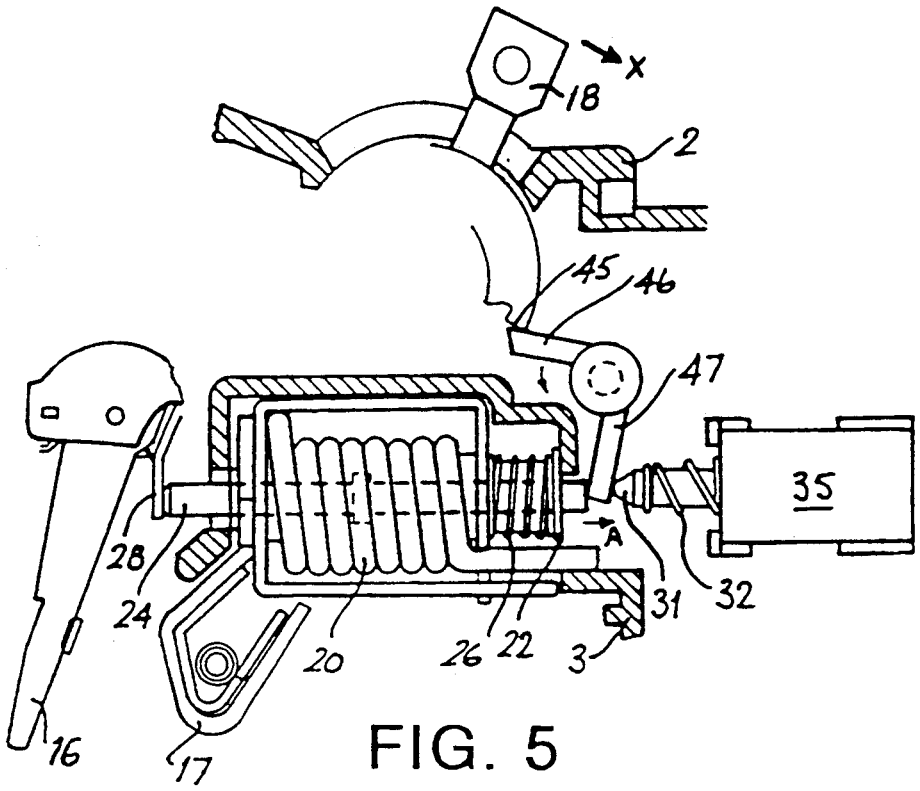
FIG. 5 is a plan view of the tripping portion in a position after tripping due to a residual current fault.
Figure 6:
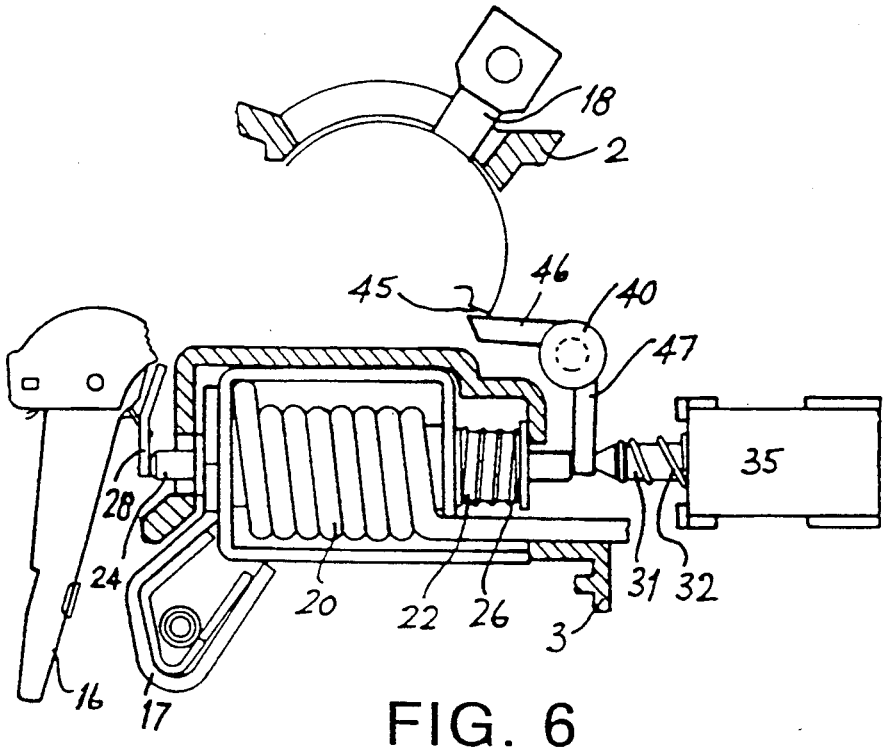
FIG. 6 is a plan view of the tripping portion in a position during reset.
Figure 7:
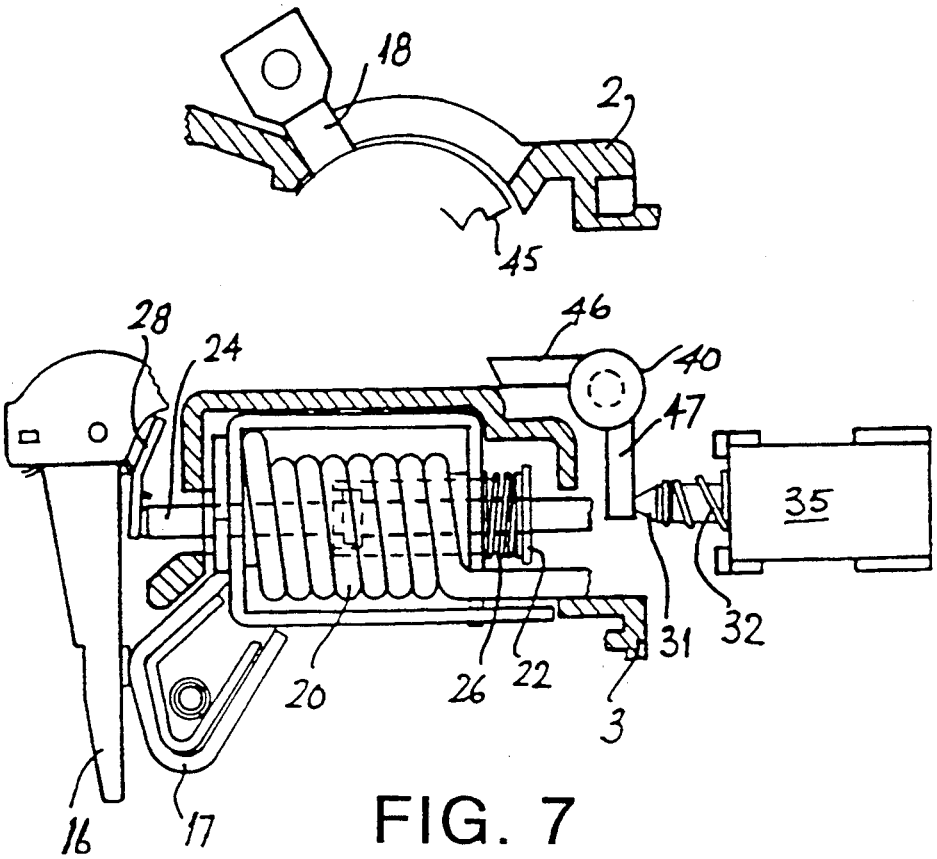
FIG. 7 is a plan view of the tripping portion in a re-set position.

To reset the breaker after a residual current trip the handle 18 is first manually moved in the direction of the arrow X in FIG. 5 towards the off position illustrated in FIG. 6. During this movement the engagement surface 45 of the handle 18 strikes the arm 46 of the reset lever 40 as illustrated in FIG. 5, pivoting the lever 40 counter clockwise and thus pushing the arm 47 of the reset lever 40 against the plunger rod 31 driving it back into the magnetic assembly housing against the biasing of the spring 32. The plunger rod 24 is then free to move back through the bore into the reset position illustrated in FIG. 6. When the handle 18 is thrown back into the on position the additional tripping device is returned to the on position illustrated in FIGS. 1, 3, and 7.

Figure 8:
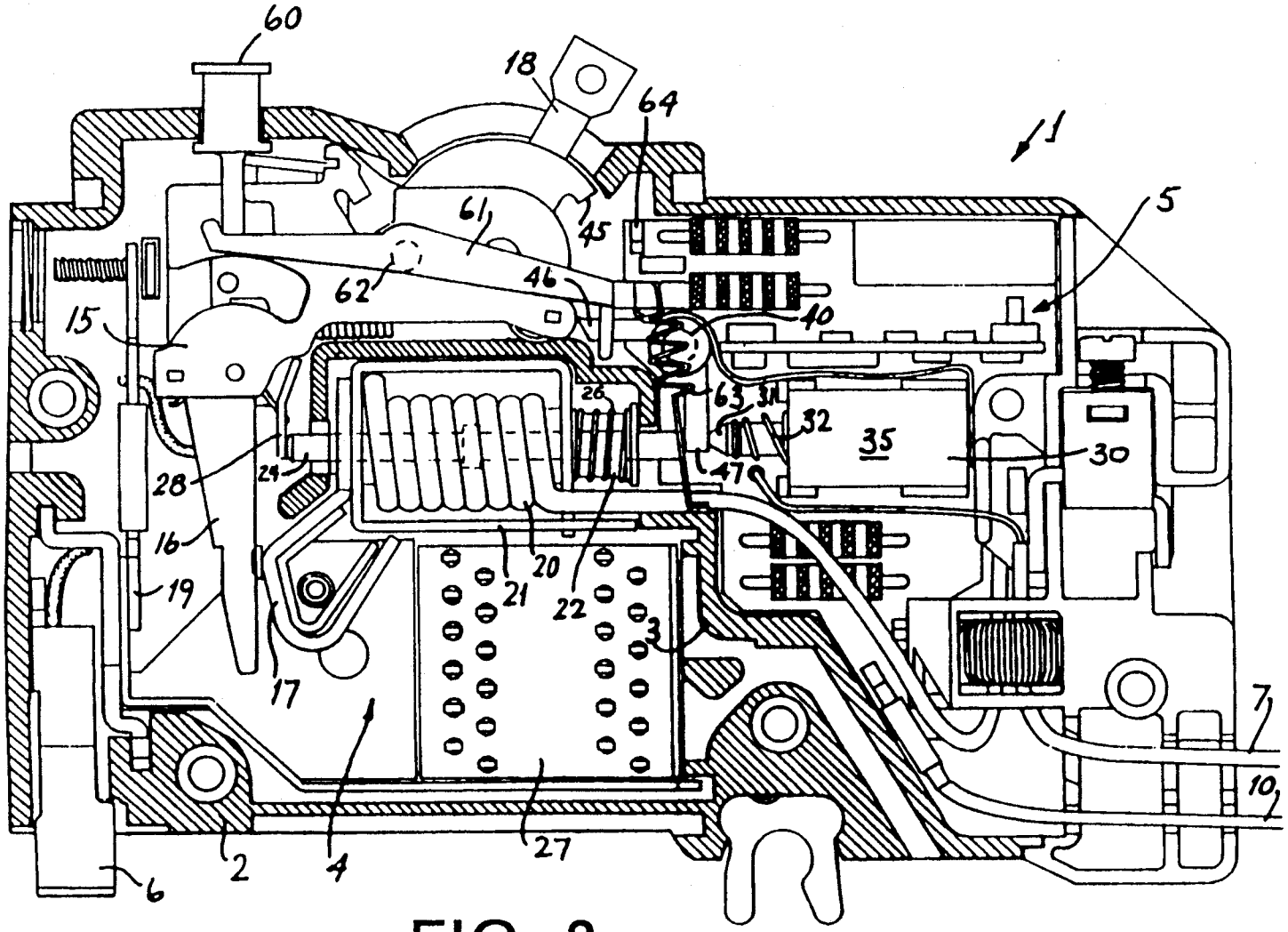
FIG. 8 is a plan view of a circuit breaker with the breaker tripped due to an over-current fault.

Referring to FIG. 8 in the event of an over-current fault occurring the armature core 22 is drawn into the coil 20 against the biasing of the spring 26, the recess 51 of the core 22 engaging with the collar 50 on the plunger rod 24 to drive the plunger rod 24 forward through the coil 20 to trip the breaker by striking the lever 28. When the breaker is tripped in this way by an over-current fault the handle 18 moves to the off position illustrated in FIG. 8.

The circuit breaker of the invention has an indicating mechanism to indicate to a user whether the breaker has tripped due to an over-current fault or for another reason, for example as described above, due to a residual current fault. The indicating mechanism is provided by operating the handle 18 and more particularly by virtue of the position of the handle 18. The handle has three positions namely an on or non-tripped position as illustrated in FIGS. 1, 2, 3, 4 and 7, an intermediate position as illustrated in FIG. 5 to which the handle travels only in the event of a residual current fault occurring, and a fully off position as illustrated in FIG. 8 to which the handle 18 travels in the event of an over-current fault. Thus, the position of the handle 18 in the event of a fault indicates to a user which type of fault—over-current or residual current—has occurred. Another advantage of the breaker of the invention is that because the plunger means is independently movable through the armature core it performs the function of tripping the breaker independently of the armature core. There is no magnetic interference between the trip mechanism via movement of the armature core in the event of an over-current fault and movement of the plunger means in the event of a residual current fault. Further, the plunger means may be used in association with a position sensing means such as an auxiliary switch to give a remote indication of the closed or open status of the breaker. The position sensing means may detect the position of the contacts directly or indirectly by sensing the position of the plunger.

Auxiliary and command devices either locally or remotely operated may be used as an alternative to the residual current detection circuit to provide a tripping signal in the event of a fault or test condition occurring.

In an embodiment of the invention the actuating device comprises a solenoid and said device is remotely operable.

In one embodiment of the invention position sensing means are provided for sensing the position of said plunger means. Preferably said position sensing means comprises switch means operated by the plunger means upon movement between the non-tripped and tripped position.

It will be appreciated that the invention provides an RCCB which is relatively simple and is reliable in operation. The use of a separate drive rod 31 and impact rod 32 allows the choice of suitable materials, in this case a plastics impact rod and ferrous drive rod. Further, resetting is relatively simple as a hand-controlled lever may be easily used.

What is claimed is:

1. A circuit breaker for use in a system having line, neutral and ground leads, comprising:

a housing;

a breaker assembly in said housing for making and breaking an electrical connection between a movable contact and a stationary contact;

an operating handle, having an on position with said contacts closed, an off position with said contacts open and an intermediate position with said contacts open, for the breaker assembly;

means for sensing over-current and thereby tripping said breaker assembly;

an additional tripping mechanism for tripping said breaker assembly;

said breaker handle moving to said intermediate position for indicating when the breaker assembly has been tripped by said additional tripping mechanism;

said over-current sensing means including a coil and an armature core in said coil, the armature core having an axial bore extending therethrough, said additional tripping mechanism comprising;

plunger means mounted within the axial bore of the armature core;

an actuating device for controlling the movement of said plunger means from a nontripping position to a tripping position;

said plunger means being independently movable through the axial bore in the armature core when moving between said non-tripping and said tripping position; and means for re-setting said plunger means to said non-tripping position.

2. The circuit breaker as claimed in claim 1 further including a residual current detection circuit for detection of a residual current in the system, and wherein said actuating device comprises a residual current actuating device for controlling the movement of said plunger means between said non-tripping position and said tripping position when a residual current fault is detected by said detection circuit.

3. The circuit breaker as claimed in claim 2 wherein said residual current actuating device comprises a drive rod which is movable upon detection of a residual current fault between a first position and a second position in which said drive rod engages and drives said plunger means into said tripping position; means for biasing said drive rod into said second position; and means for retaining said drive rod in said first position.

4. The circuit breaker as claimed in claim 3 wherein said retaining means comprises a permanent magnet to hold said drive rod in said first position and an electromagnet to neutralize the effect of said permanent magnet on said drive rod upon detection of a residual current fault.

5. The circuit breaker as claimed in claim 3 wherein said biasing means comprise spring means for driving said drive rod into said second position.

6. The circuit breaker as claimed in claim 3 wherein said resetting means comprises a reset lever interposed between said drive rod and said plunger means and a reset actuator for moving said reset lever to return said drive rod to said first position against the action of said biasing means.

7. The circuit breaker as claimed in claim 6 wherein said reset actuator comprises said operating handle which engages said reset lever when said operating handle is moved from said intermediate position to said off position with said contacts open.

8. The circuit breaker as claimed in claim 7 wherein said reset lever is pivotally mounted to said housing intermediate the ends of said reset lever and comprises a first lever arm for engagement by said operating handle and a second lever arm interposed between said drive rod and said plunger means.

9. The circuit breaker as claimed in claim 8 wherein said reset lever is substantially L shaped.

10. The circuit breaker as claimed in said claim 1 wherein said plunger means includes a plunger rod and wherein engagement means are provided intermediate the ends of said plunger rod for engagement by said armature core upon occurrence of an over-current fault, said engagement means being provided substantially at the midpoint along the longitudinal axis of said plunger rod.

11. The circuit breaker as claimed in claim 10 wherein said engagement means comprises a radially outwardly extending collar engagable in a complementary shaped recess in said armature core.

12. The circuit breaker as claimed in claim 11 wherein said plunger rod is slidably mounted in a bushing provided in said coil at the end thereof remote from said armature core.

13. The circuit breaker as claimed in claim 1 wherein said actuating device comprises a solenoid, and said actuating device is remotely operable.

14. A circuit breaker as claimed in claim 1 wherein position sensing means are provided for sensing the position of said plunger means.

15. The circuit breaker as claimed in claim 14 wherein said position sensing means comprises switch means operated by said plunger means upon movement between said non-tripping and said tripping position.

* * * * *